US007950513B2

(12) United States Patent
Horian

(10) Patent No.: US 7,950,513 B2
(45) Date of Patent: May 31, 2011

(54) COIN DROP MECHANISM

(75) Inventor: James G. Horian, Newport Beach, CA (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 0 days.

(21) Appl. No.: 12/338,818

(22) Filed: Dec. 18, 2008

(65) Prior Publication Data

US 2009/0188770 A1 Jul. 30, 2009

Related U.S. Application Data

(63) Continuation of application No. 10/602,796, filed on Jun. 24, 2003, now Pat. No. 7,469,779.

(51) Int. Cl.

| | |
|---|---|
| ***G07F 5/00*** | (2006.01) |
| ***G07F 11/00*** | (2006.01) |
| ***G07F 13/00*** | (2006.01) |
| ***G07F 15/00*** | (2006.01) |
| ***G07F 17/00*** | (2006.01) |

(52) U.S. Cl. ..... 194/247; 194/232; 194/282; 194/334; 194/344; 194/351; 221/298

(58) Field of Classification Search ..... 221/301, 221/194, 17, 20, 103, 151–153, 226, 227, 221/230, 232, 272–274, 276, 298–299; 194/344–346, 225–228, 282, 232–238, 247–259, 194/283–289, 294–300, 302, 334–338, 351
See application file for complete search history.

(56) References Cited

U.S. PATENT DOCUMENTS

| | | | | |
|---|---|---|---|---|
| 441,536 | A | 11/1890 | Cornell | |
| 1,096,353 | A | 5/1914 | Coe et al. | |
| 1,621,619 | A | 3/1927 | Ashe | |
| 2,348,434 | A | 5/1944 | Henry | |
| 2,873,012 | A | 2/1959 | Lux | |
| 2,984,326 | A | 5/1961 | Westphal | |
| 3,250,432 | A | 5/1966 | Green et al. | |
| 3,946,846 | A | 3/1976 | Pepiciello et al. | |
| 4,469,211 | A | 9/1984 | Shipman, Sr. | |
| 4,591,042 | A | 5/1986 | Wenner | |
| 4,693,357 | A | 9/1987 | Aschenbeck et al. | |
| 4,726,457 | A | 2/1988 | Shteyngarts et al. | |
| 4,823,984 | A | 4/1989 | Ficken | |
| 5,167,345 | A | 12/1992 | Bleeker | |
| 5,176,287 | A | 1/1993 | Suris | |
| 5,199,598 | A * | 4/1993 | Sampson | 221/194 |
| 5,915,519 | A * | 6/1999 | Glaser | 194/345 |
| 6,929,110 | B2 | 8/2005 | Dobbins et al. | |

FOREIGN PATENT DOCUMENTS

EP 1 837 834 A1 9/2007

* cited by examiner

*Primary Examiner* — Jeffrey A Shapiro
(74) *Attorney, Agent, or Firm* — Christie, Parker & Hale, LLP

(57) ABSTRACT

A coin drop mechanism comprises a support member movably connected to a channel member. A contoured channel configured to receive at least one coin is formed on at least one of the members and defines a coin slot when the members are in contact with each other. The channel is configured to guide the at least one coin to a desired location aligned with an actuator opening on the members. The mechanism further comprises an actuator. The actuator comprises a actuation member configured to travel through the actuator opening, engage the at least one coin against a surface of the channel member, and displace the channel member relative to the support member causing a selected product to be dispensed from a product receptacle.

28 Claims, 11 Drawing Sheets

COIN DROP MECHANISM

CROSS REFERENCE TO RELATED APPLICATION

This application is a continuation of U.S. patent application Ser. No. 10/602,796 filed on Jun. 24, 2003 now U.S. Pat. No. 7,469,779, the contents of which are hereby fully incorporated herein by reference.

FIELD OF THE INVENTION

The present invention relates to vending machines and, more particularly, to a coin mechanism used to actuate vending machines.

BACKGROUND OF THE INVENTION

Vending machines and coin mechanisms for operating such machines are well known in the art. Such vending machines are located in a variety of locations, often making the machines subject to weather extremes and abuse, such as fraudulent attempts to obtain product without inserting the required purchase price. Accordingly the coin mechanism for such machines must be of a non-complex design capable of withstanding such abuse.

Some conventional coin mechanisms are complex and utilize electronic parts to actuate the coin mechanism. Other conventional coin mechanism designs are mechanically operated but employ a complex arrangement. Although such mechanisms may be versatile and perform well under ideal conditions, they are inherently expensive and prone to requiring frequent maintenance due to the harsh conditions under which vending machines sometimes operate.

Conventional coin mechanism designs that are mechanically operated usually require a user to turn a knob or rotate a lever to actuate the mechanism. Such modes of actuation are difficult and sometimes painful for individuals with limited hand movement, such as individuals who suffer from arthritis or similar debilitating conditions.

SUMMARY OF THE INVENTION

In one embodiment of the present invention, a coin mechanism includes a coin slot formed via the interaction of two movably joined members, where at least one of the members has a contoured channel formed thereon. The contoured channel is configured to receive and guide at least one coin of a required denomination to a desired position aligned with an actuator opening on at least one of the members.

A user can actuate the coin mechanism to dispense a product by actuating an actuator. The actuator causes an actuation member to travel through the actuator opening in one member, engage a coin against the surface of the channel member, and displace the channel member relative to the support member. The channel member is connected to a product delivery system, which is configured to deliver a desired product upon displacement of the channel member.

The coin mechanism advantageously does not require complex electronic or mechanical parts. Additionally, the mechanism advantageously does not require the turning of a knob or rotation of a lever, minimizing the discomfort or pain suffered by individuals with limited hand movement during actuation of the mechanism.

Further, the contoured shape of the of the coin mechanism channel advantageously prevents fraudulent attempts to obtain a selected product by inserting, for example, an elongated flat object into the coin slot instead of the at least one coin.

Other embodiments, advantages, and features of the present invention will become readily apparent to those skilled in this art from the ensuing detailed description of preferred embodiments thereof.

DETAILED DESCRIPTION OF THE INVENTION

Figure 1B:
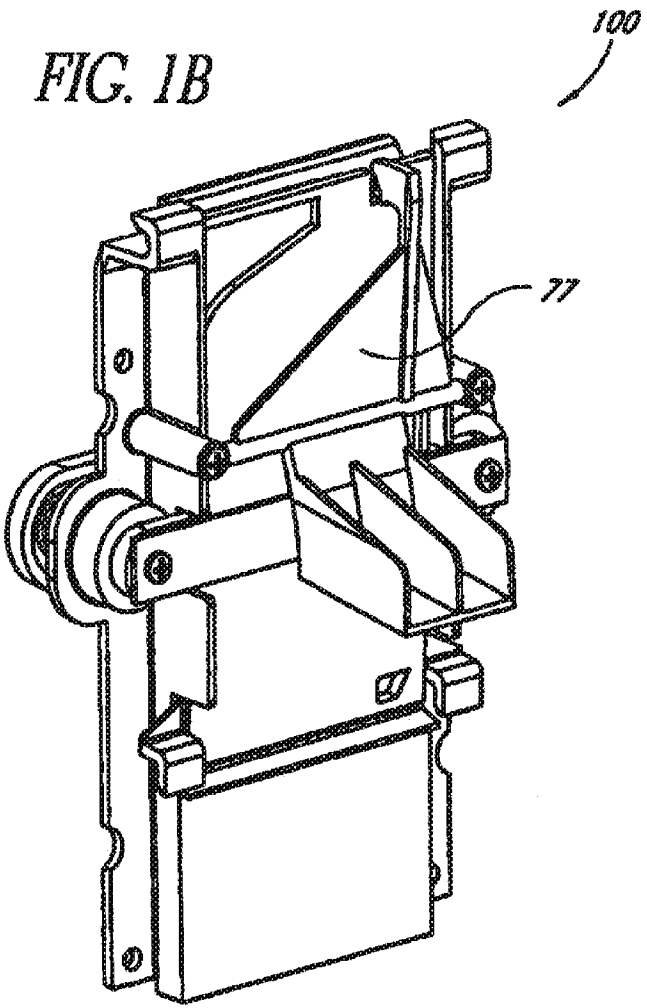
FIG. 1*b* is a rear perspective view of the mechanism of FIG. 1.
Figure 1A:
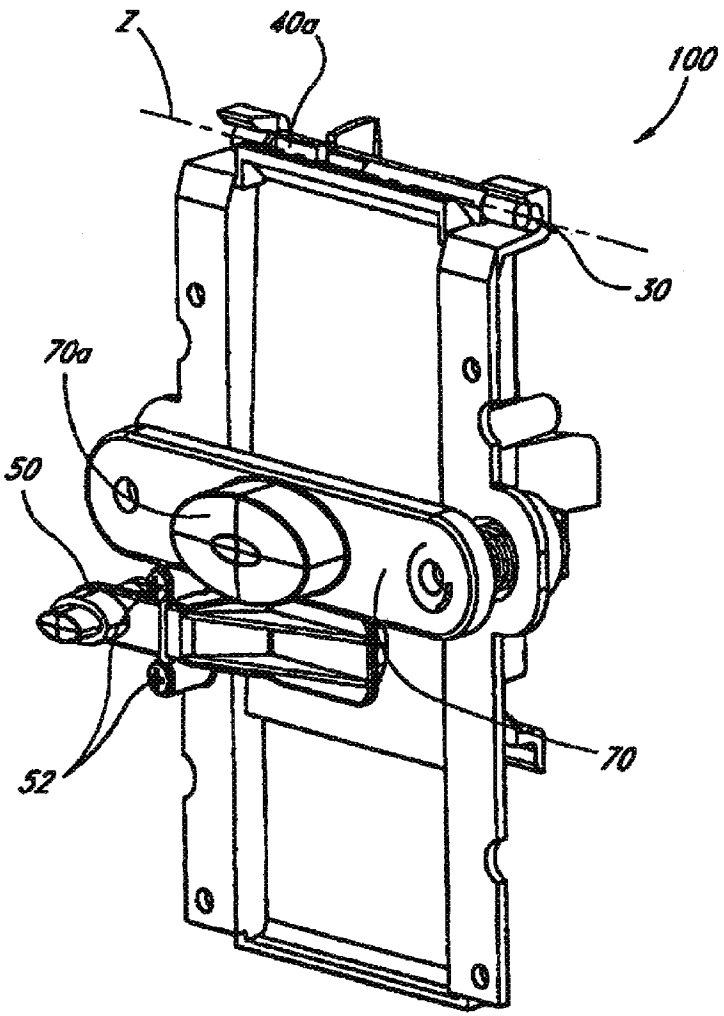
FIG. 1*a* is a frontal perspective view of one embodiment of a coin mechanism.

FIGS. 1*a*-1*f* illustrate a coin mechanism 100 according to one embodiment of the present invention. The mechanism 100 preferably comprises a support member 10 and a channel member 20. The members 10, 20 are shown as plates 10, 20 in the illustrated embodiment. However, the members 10, 20 are not limited to any geometrical shape. The members 10, 20 comprise inner surfaces 12*a*, 22*a* and outer surfaces 12*b*, 22*b*, respectively.

The members 10, 20 are preferably made of metal, such as steel or aluminum. However, the members 10, 20 can be made of any material having structural characteristics suitable for use in a coin mechanism 100, such as a hard plastic. Additionally, the members 10, 20 are preferably connected together so as to allow movement of the members 10, 20 relative to each other about an axis "Z". For example, the support member 10 can have a female portion 30*a*, such as a hook, and the channel member 20 can have a male portion 30*b* configured to fit in the female portion 30*a* to form a hinge 30 that connects the members 10, 20. However, the members 10, 20 can be connected using any structure that allows them to pivot relative to each other.

At least one of the members 10, 20 preferably comprises a contoured channel 40 formed on a surface thereof extending from a proximal end 24 to a distal end 26. In the illustrated embodiment, the channel 40 is formed on the inner surface 22*a* of the channel member 20. The channel 40 is configured to define a slot 40*a* between the members 10, 20 when the members 10, 20 are in contact with each other.

The channel 40 comprises a first and second contoured walls 42*a*, 42*b*. The walls 42*a*, 42*b* preferably extend from the proximal end 24 to the distal end 26 of the channel 40. Additionally, the walls 42*a*, 42*b* are preferably configured to allow coins of denominations other than that required for operation of the mechanism 100 to fall through the channel 40, as discussed further below.

The contoured channel 40 is preferably configured to receive and guide at least one coin of a specific denomination required by the mechanism 100 to a desired location on the channel 40. Accordingly, the channel member 20 functions as a coin receiving channel member. For example, the channel 40 can be configured to receive quarters. Additionally, the contoured walls 42*a*, 42*b* are preferably configured to allow the mechanism 100 to operate only with coins of the specific denomination, as discussed further below.

Two coins 44*a*, 44*b* are shown in the illustrated embodiment, but it is understood by one of ordinary skill in the art that the mechanism 100 can equally operate with any number of coins. In one embodiment, the contoured channel 40 guides X−1 of X number of coins (not shown) inserted into the mechanism 100 to a desired location, such that the X−1 coins are disposed substantially adjacent to each other about a common axis. In this embodiment, the channel 40 is configured to guide the X coin to a location on top of the X−1 coins. As used herein, X represents a numerical quantity of coins.

Figure 1C:
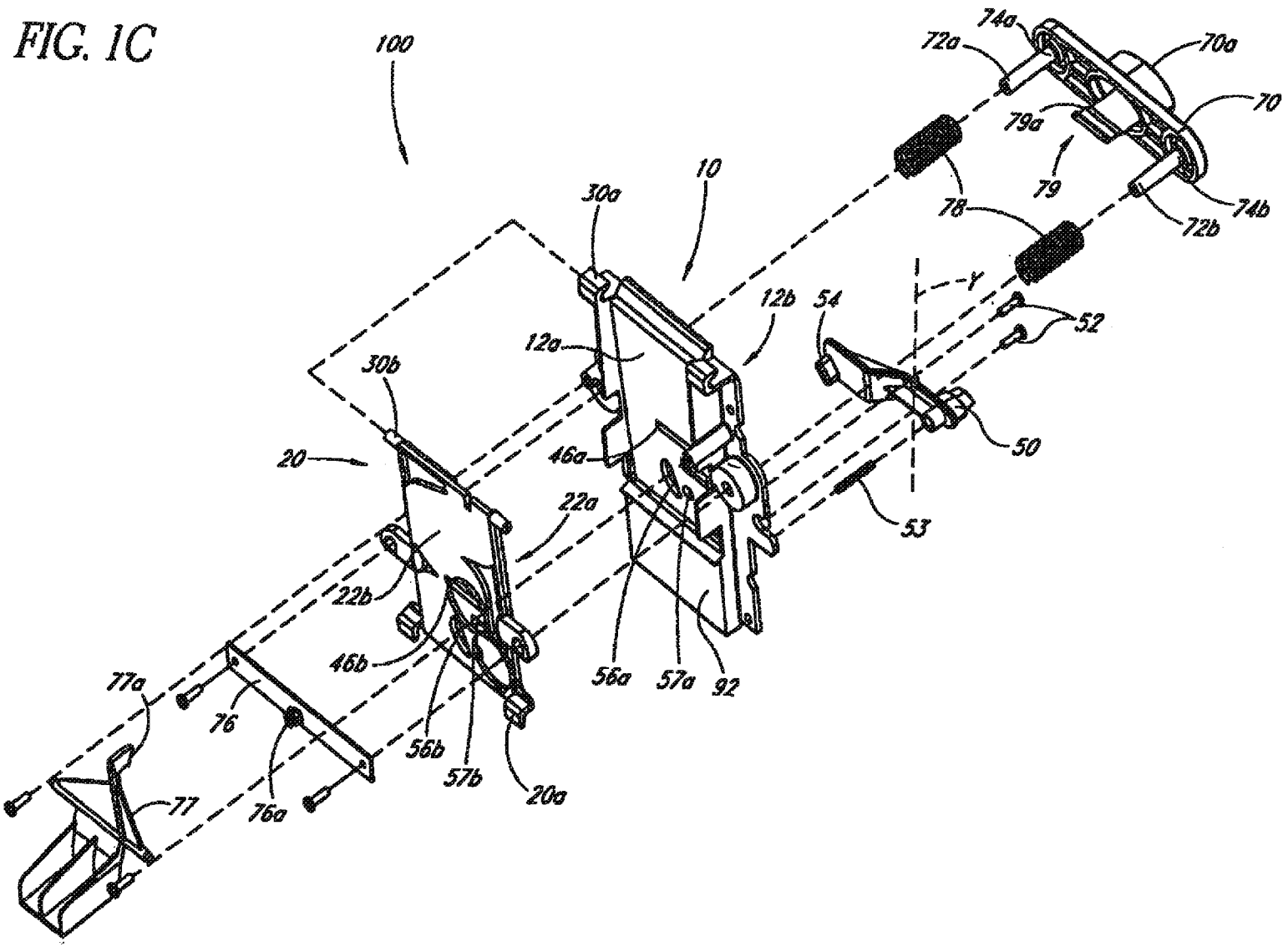
FIG. 1*c* is an exploded perspective view of the coin drop mechanism of FIG. 1.
Figure 1D:
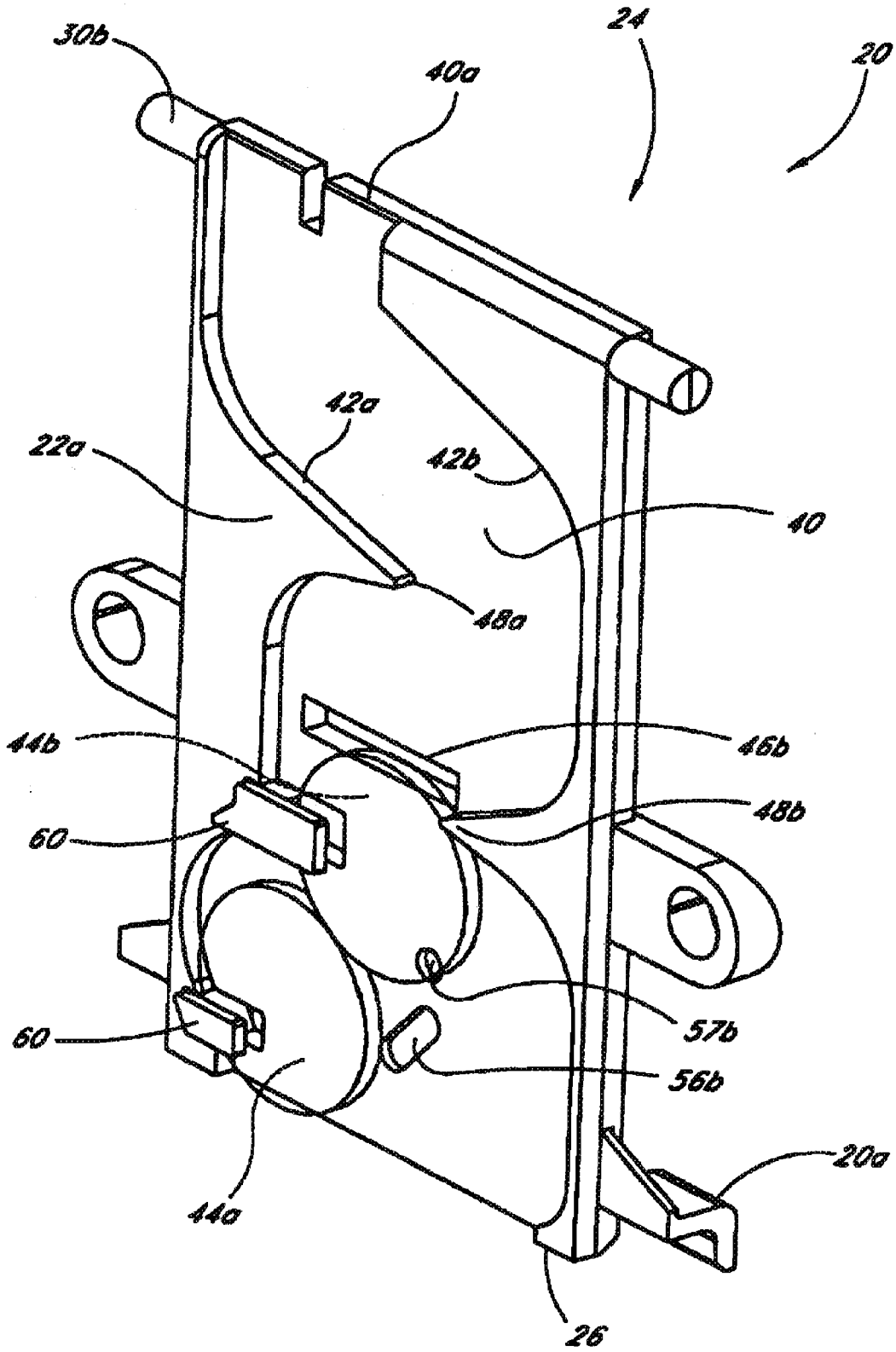
FIG. 1*d* is a perspective frontal view of a coin receiving channel member in accordance with one embodiment of a coin drop mechanism.

As illustrated in FIGS. 1*c*-1*d*, the channel 40 is further configured to align one of the coins 44*b* with actuator openings 46*a*, 46*b* formed on the members 10, 20 when the coin 44*b* is in the desired location. The contoured walls 42*a*, 42*b* of the channel 40 each preferably comprises at least one protrusion 48*a*, 48*b* configured to help guide the coins 44*a*, 44*b* to the desired location.

The mechanism 100 optionally comprises a coin return actuator 50 removably connected to the support member 10 with a fastener 52. The actuator 50 can optionally comprise a spring 53 and be configured to pivot about an axis "Y" defined by the fastener 52. The fastener 52 can be, for example, a bolt or a screw or multiple bolts or screws, or a snap-fit pivot. However, one of ordinary skill in the art will recognize that any fastener 52 suitable for removably connecting the coin return actuator 50 to the support member 10 can be used.

The coin return actuator 50 preferably comprises a protrusion 54 configured to protrude through an opening 56*a* formed on the support member 10, through the channel 40, and into a recessed opening 56*b* formed on the channel 40. The protrusion 54 is further preferably configured to contact and hold one coin 44*a* against the contoured wall 42*a* when the coin return actuator 50 is not actuated. Similarly, when the coin return actuator 50 is actuated, the protrusion 54 is preferably configured to disengage the coin 44*a*, to travel out of the recessed opening 56*b*, and to travel into the opening 56*a* at least enough so the protrusion 54 does not protrude from the inner surface 12*a* of the support member 10.

Figure 1E:
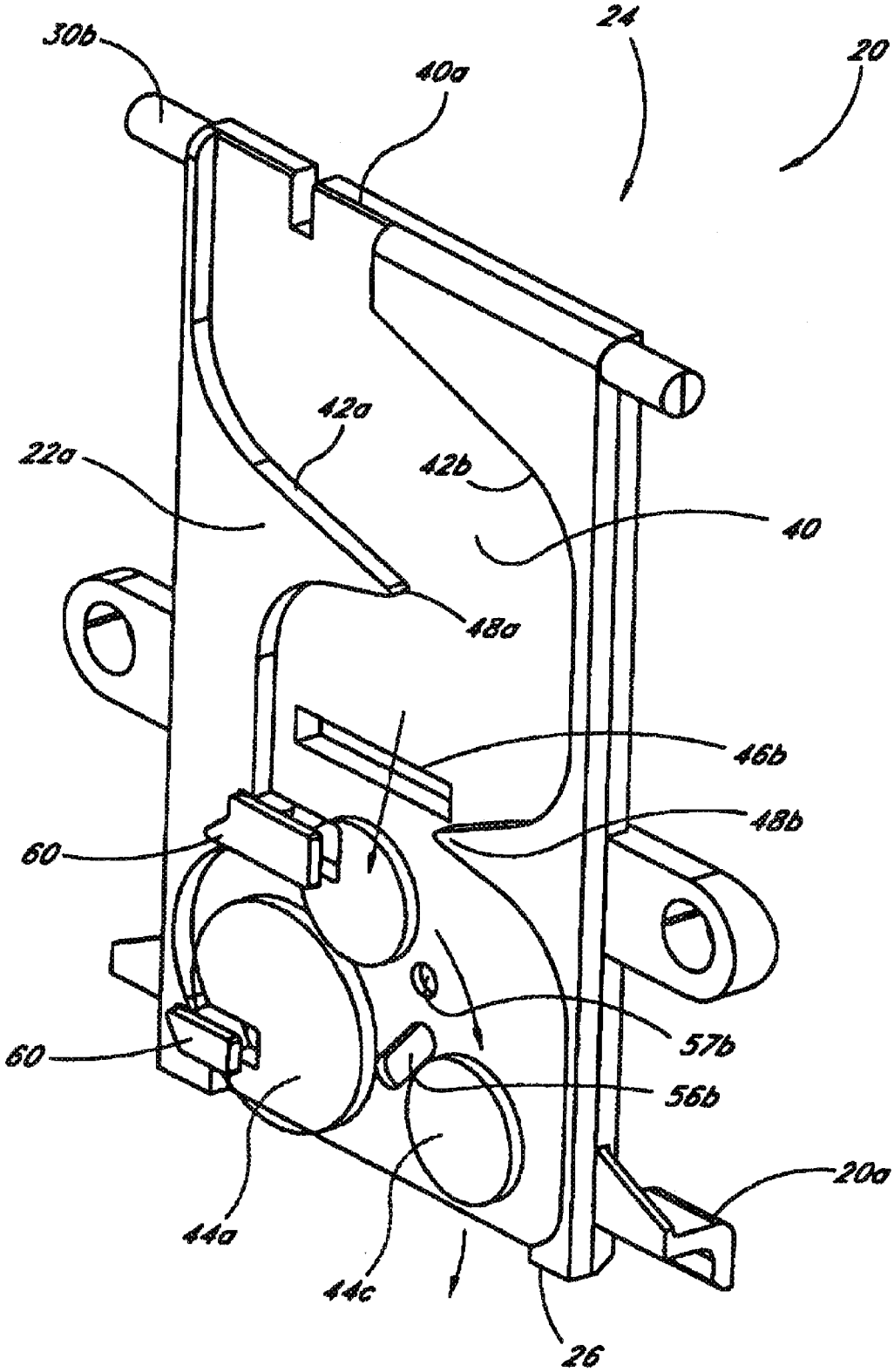
FIG. 1*e* is perspective view of the coin receiving channel member in FIG. 1*d* with a coin of a different denomination than required by the coin drop mechanism.
Figure 1F:
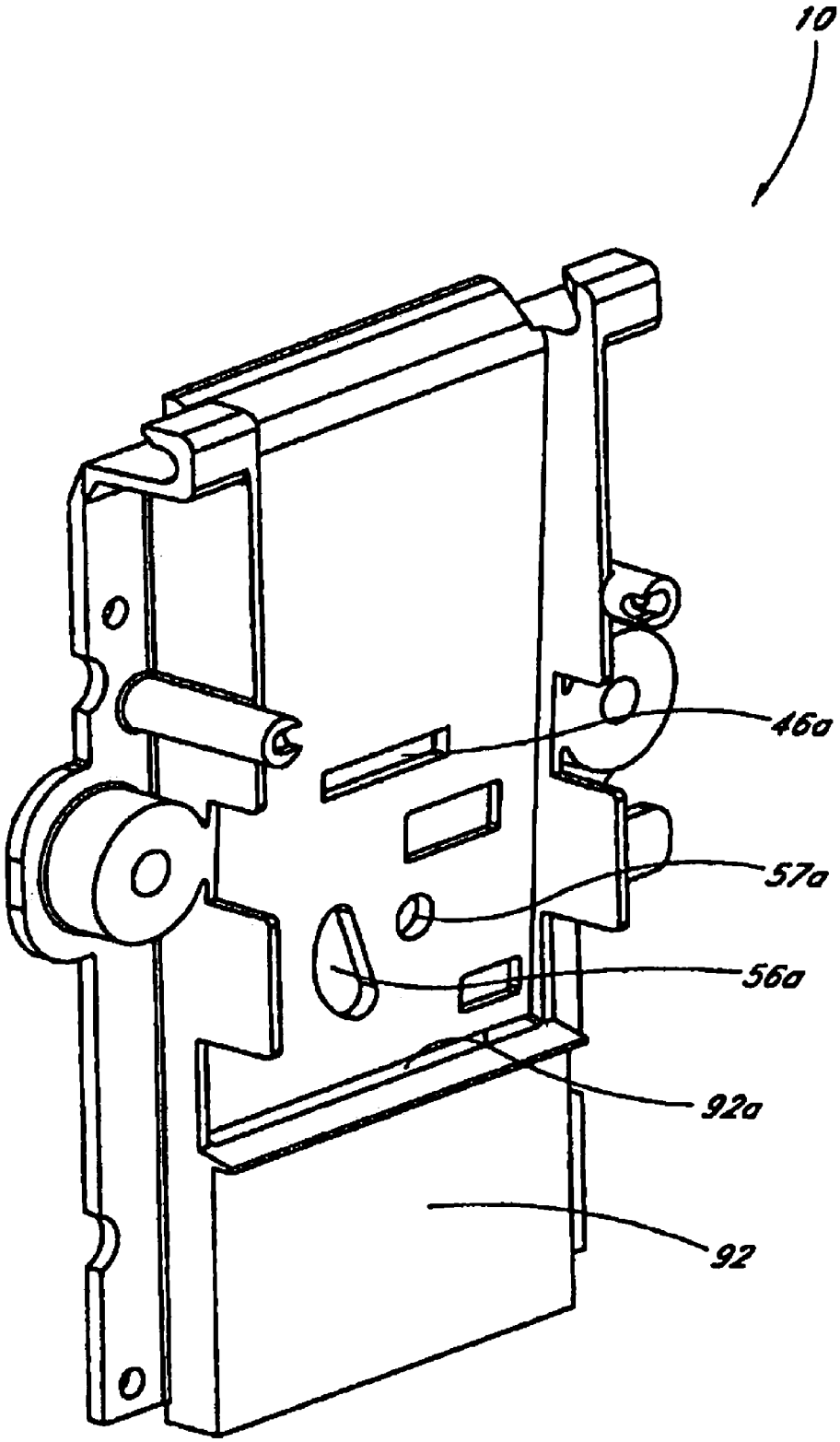
FIG. 1*f* is a rear perspective view of a support member in accordance with one embodiment of a coin drop mechanism.

In the illustrated embodiment, the coin mechanism 100 is configured to operate with two coins 44*a*, 44*b*, such as quarters. As noted above, the protrusion 54 is configured to engage one of the coins 44*a* against the contoured wall 42*a* when the coin return actuator 50 is not actuated. The protrusion 54 is preferably disposed in relation to the contoured walls 42*a*, 42*b* so as to contact and hold only coins inserted into the channel 40 that are of the specific denomination required for operation of the mechanism 100. That is, coins of a different denomination than that required for the actuation of the mechanism 100 would fall through the channel 40 into a coin return area 92, preferably formed on the support member 10 and aligned with the channel 40, via a coin return slot 92*a*. Additionally, the protrusion 54 is further preferably disposed in relation to the contoured walls 42*a*, 42*b* such that even if a user inserted a first coin 44*a* of the required denomination into the channel 40, said coin 44*a* held by the protrusion 54, coins of a different denomination 44*c* subsequently inserted into the channel 40 would fall through the channel 40 into the coin return area 92, as illustrated in FIG. 1*e*.

In another embodiment (not shown), the coin mechanism 100 can operate with just one coin 44*b*. In this embodiment, a protrusion (not shown) of a coin-return actuator (not shown) is preferably extendable through a second opening, such as opening 57*a* formed on the support member 10, through the channel 40, and into a second recessed opening 57*b* formed on the channel 40. For example, the protrusion can have a cylindrical shape (not shown) configured to contact and hold the coin 44*b* against the contoured wall 42*a*. As discussed above, the protrusion is preferably disposed in relation to the contoured walls 42*a*, 42*b* so as not to contact and hold coins inserted into the channel 40 that are not of the specific denomination required for operation of the coin mechanism 100. For example, if the coin mechanism 100 is configured to operate with one quarter, and a user instead inserts a nickel, the nickel would fall through the channel 40 and into a coin return area 92.

The mechanism 100 optionally comprises at least one coin guide 60 disposed, for example, on the inner surface 22*a* of the channel member 20. The at least one coin guide 60 preferably protrudes over the contoured channel 40 and is configured to contact, the at least one coin 44*a*, 44*b* during actuation of the coin mechanism 100.

FIG. 1*c* illustrates an exploded view of one embodiment of the coin drop mechanism 100. The coin drop mechanism 100 preferably comprises an actuator 70 disposed frontward of the outer surface 12*b* of the support member 10.

The actuator 70 preferably comprises a contact portion 70*a* and at least one support element slidably disposed through the members 10, 20. The actuator 70 comprises two support elements 72*a*, 72*b* in the illustrated embodiment. Each of the support elements 72*a*, 72*b* defines front portion 74*a*, 74*b* disposed between the contact portion 70*a* and the support member 10. The support elements 72*a*, 72*b* preferably removably connect to a third member 76 disposed next to the channel member 20. The third member 76 preferably comprises a spring 76*a* configured to contact a flag member 77*a* movably connected to the support member 10. Each front portion 74*a*, 74*b* preferably comprises a spring element 78. The actuator 70 further comprises an actuation member 79 configured to travel through at least one of the actuator openings 46*a*, 46*b* of the members 10, 20. In one embodiment, the actuation member 79 preferably is a rectangular metal bar or plate formed, for example, via a stamping process. However, the actuation member 79 can have other shapes suitable for use in the coin mechanism 100, such as square, oval, and round. Additionally, the actuation member 79 can be made of other materials with structural characteristics suitable for use in the coin mechanism 100, such as a hard plastic.

Figure 2A:
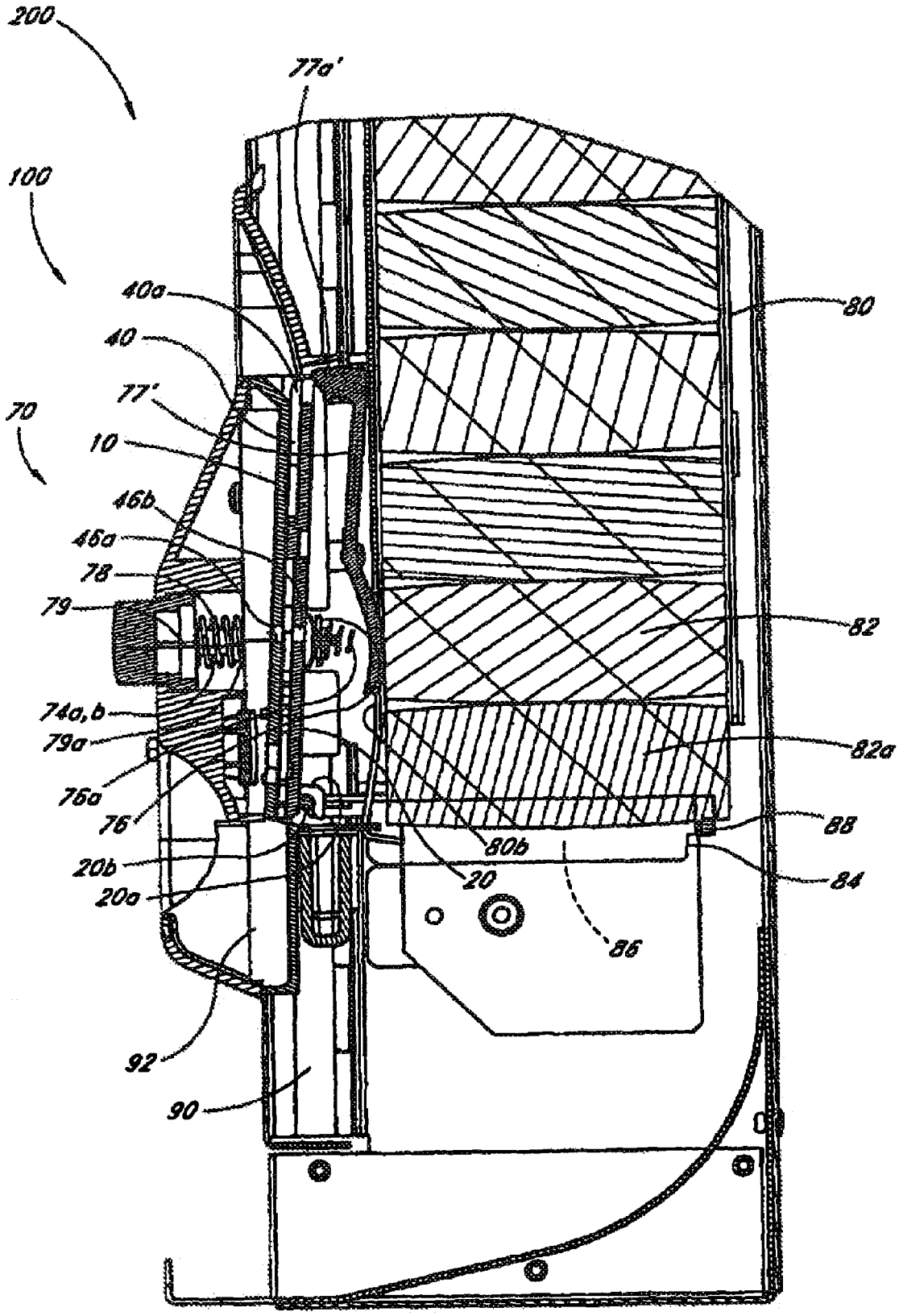
FIG. 2*a* is a crossectional side view of a vending machine incorporating one embodiment of a coin drop mechanism in a non-actuated state.

FIG. 2*a* illustrates a vending machine 200 incorporating one embodiment of the coin drop mechanism 100. The vending machine 200 preferably has a product receptacle 80 configured to hold at least one product 82 therein. In the illustrated embodiment, the product receptacle 80 is configured to receive and hold a plurality of individual products 82. The channel member 20 preferably connects to a product support member 84 defining an opening 86 therethrough. For example, in one embodiment, the channel member 20 has a female portion 20*a*, such as a hook, that removably receives a male portion 20*b* of the product support member 84 therein. However, any structure suitable for connecting the channel member 20 to the product support member 84 can be used. In one embodiment, the channel member 20 and the product support member 84 are integrally formed. The opening 86 of the support member 84 defines an edge 88 configured to contact and support a selected product 82*a* in the product receptacle 80. Additionally, in one embodiment, the product support member 84 can be slidably connected to the product receptacle 80 via a rail system (not shown). Alternatively, the product support member 84 can be movably connected to the product receptacle 80 using other suitable structure(s).

During operation, a user inserts the at least one coin 44*a*, 44*b* into the slot 40*a*. The channel 40 guides the at least one coin 44*a*, 44*b* to a desired location, preferably via gravity, such that the at least one coin 44*b* is aligned with the actuator openings 46*a*, 46*b*. The user then preferably actuates the actuator 70 by pressing the contact portion 70*a*, thus generating an actuation force.

Figure 2B:
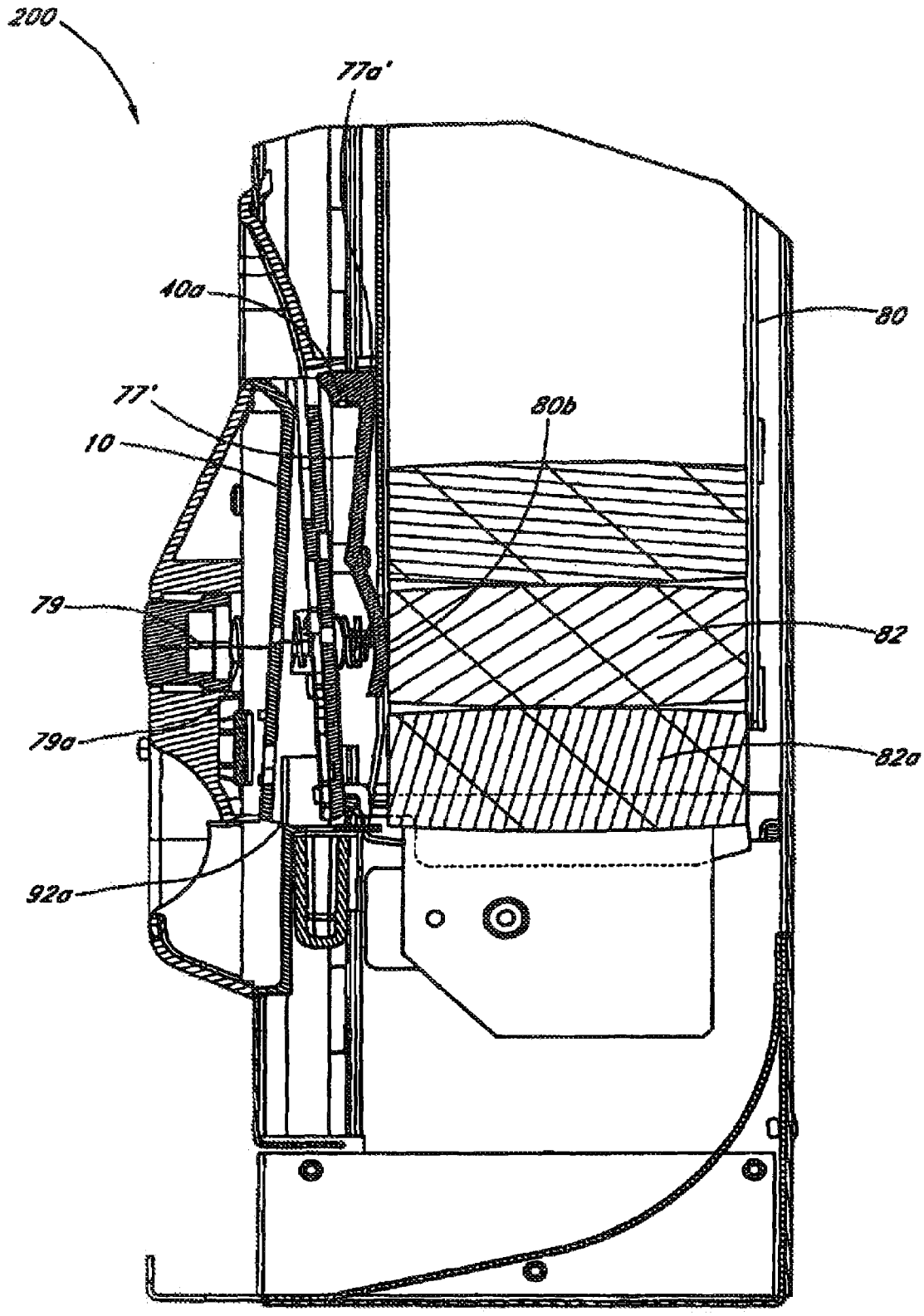
FIG. 2*b* is a crossectional side view of the vending machine of FIG. 2*a* with the coin drop mechanism in an actuated state.

When a user actuates the actuator 70, the support elements 72*a*, 72*b* movably displace through the members 10, 20, which in turn displaces the third member 76 such that the spring 76*a* contacts the flag member 77', as shown in FIG. 2*b*. The spring 76*a* preferably causes the flag member 77' to pivot so as to contact and hold in place at least one of the products 82 in the product receptacle 80 through an opening 80*b*. The product 82 are preferably disposed above the selected product 82*a*. At least one spring element 78 disposed on the front portions 74*a*, 74*b* of the support elements 72*a*, 72*b* generates a return force on the contact portion 70*a* of the actuator 70.

Figure 2C:
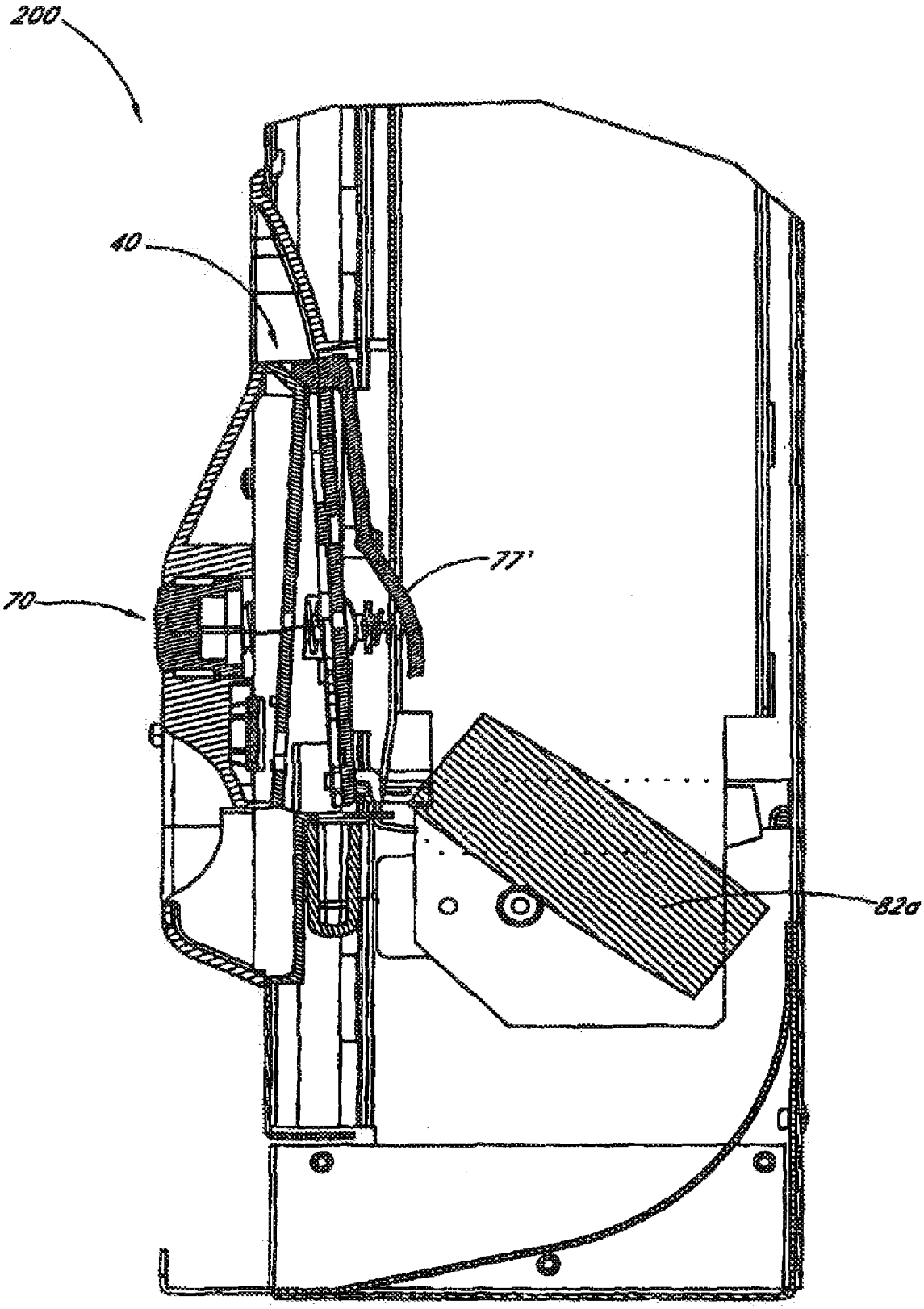
FIG. 2*c* is a crossectional view of the vending machine of FIG. 2*a* with the coin drop mechanism in an actuated state while dispensing the last product in the machine.

Additionally, actuation of the actuator 70 causes the actuation member 79 to travel through the actuator opening 46*a* in the support member 10, engage the at least one coin 44*b* with an edge thereof, and transmit the actuation force to the at least one coin 44*b* to displace the channel member 20 relative to the support member 10, as shown in FIG. 2*b*. Displacement of the channel member 20 relative to the support member 10 causes at least one of the coins 44*a*, 44*b* to fall into a coin bank 90. Also, displacement of the channel member 20 in turn displaces the product support member 84 such that the opening 86 is aligned with the selected product 82*a*, causing the selected product 82*a* to be dispensed from the receptacle 80, as shown in FIG. 2*c*. In one embodiment, the actuation member 79 comprises a stepped portion 79*a* along its length. At some point during the actuation process, when the stepped portion 79*a* passes through the actuator opening 46*a* in the support member 10, the edge in contact with the at least one coin 44*b* shifts relative to the coin 44*b*, causing the edge to release the coin 44*b*, which falls into the coin bank 90. Release of the coin 44*b* preferably coincides with the dispensing of the selected product 82*a* from the receptacle 80.

Upon release of the actuator 70, the support elements 72*a*, 72*b* movably displace such that the spring 76*a* of the third member 76 disengages the flag member 77', which in turn disengages the product 82 in the receptacle 80. Additionally, the actuation member 79 withdraws from the channel member 20 and into the actuator opening 46*a*. The return force caused by the at least one spring element 78 causes the third member 76 to displace the channel member 20 into contact with the support member 10. Displacement of the channel member 20 in turn displaces the product support member 84 such that the edge 88 of the opening 86 contacts and supports the products 82 in the product receptacle 80.

The coin mechanism 100 advantageously prevents dispensation of a product without having inserted the required number of coins into the mechanism 100. If a user attempts to obtain a product without any coins in the mechanism 100 by actuating the actuator 70, the actuation member 79 travels through the actuator openings 46*a*, 46*b* in both members 10, 20 without causing the channel member 20 to displace relative to the support member 10.

Additionally, the contoured walls 42*a*, 42*b* of the channel 40 prevent a user from inserting, for example, an elongated flat element into the coin slot 40*a* in an attempt to actuate the coin mechanism 100 without inserting the at least one coin 44*a*, 44*b*. Further, as discussed above, the coin mechanism 100 advantageously prevents use of coins that are not of the specific denomination required by the mechanism 100, by allowing said different coins to fall through the channel 40 and into the coin return area 92 via the coin return slot 92*a*. Additionally, the at least one coin guide 60 also advantageously prevents the at least one coin 44*a*, 44*b* from falling into the coin return area 92 when the mechanism 100 is actuated. The at least one coin guide 60 is configured to direct the at least one coin 44*a*, 44*b* away from a location above the coin return area 92 and toward a location above the coin bank 90 when the mechanism 100 is actuated to displace the channel member 20 relative to the support member 10.

In one embodiment, the flag member 77' advantageously prevents a user from inserting coins into the coin slot 40*a* when the vending machine 200 is out of product. As discussed above, during actuation of the coin mechanism 100, the flag member 77' contacts and holds at least one of the products 82 in the product receptacle 80 while the product support member 84 is displaced so as to dispense only the selected product 82*a*, as shown in FIGS. 2*b*-*c*. When there is only one selected product 82*a* in the receptacle 80, and there is not at least one product 82 disposed above the selected product 82*a*, actuation of the coin mechanism 100 causes the spring 76*a* of the third member 76 to pivot the flag member 77' into a locked position such that a blocking portion 77*a'* protrudes into the slot 40*a*. The blocking portion 77*a'* prevents a user from inserting coins into the coin slot 40*a* after the last selected product 82*a* has been dispensed. The flag member 77' can be reset to an unlocked position by an operator upon placement of at least one product 82, in addition to the selected product 82*a*, in the receptacle 80.

Figure 3A:
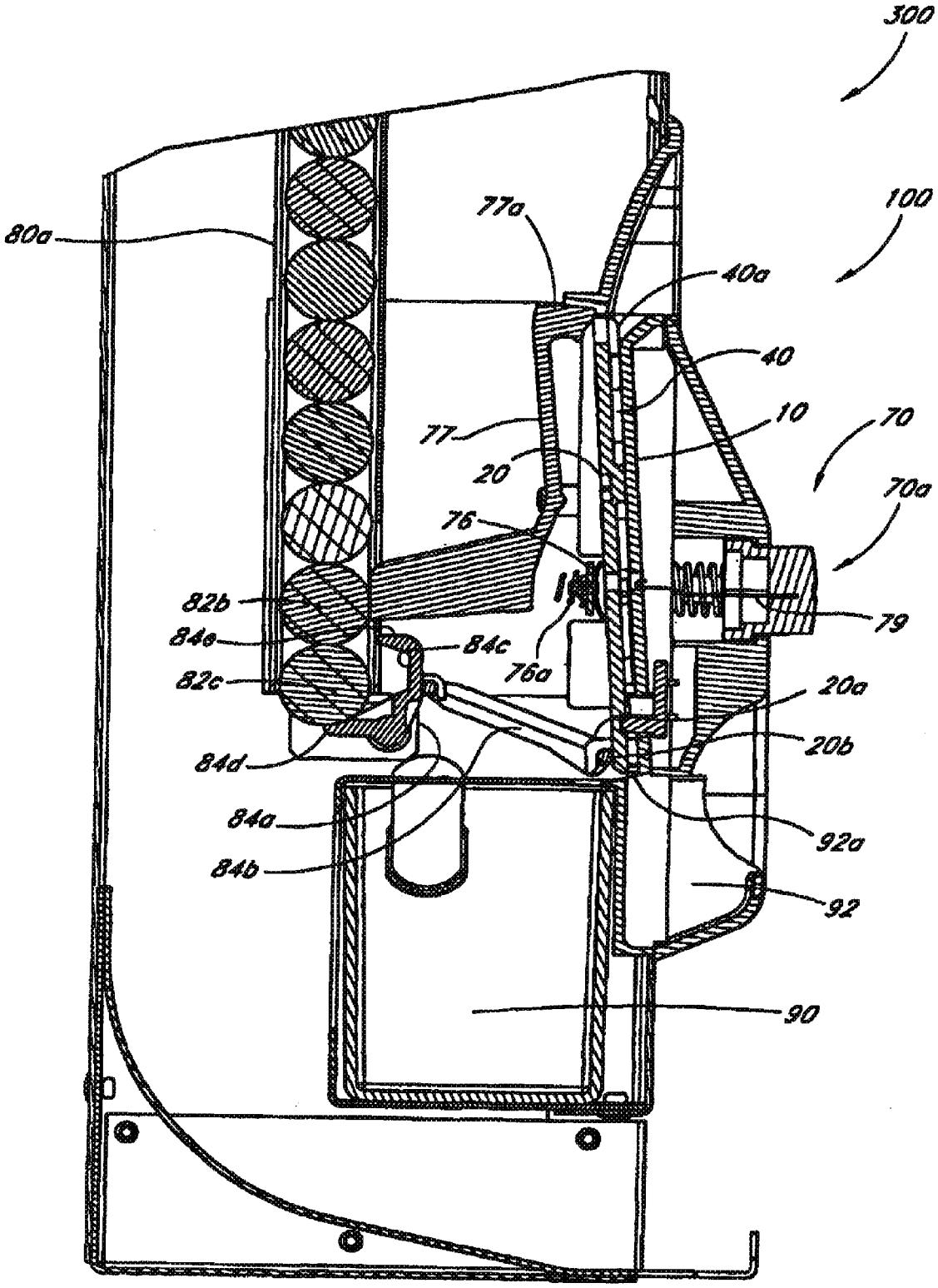
FIG. 3*a* is a crossectional side view of another vending machine incorporating one embodiment of a coin drop mechanism in a non-actuated state.
Figure 3B:
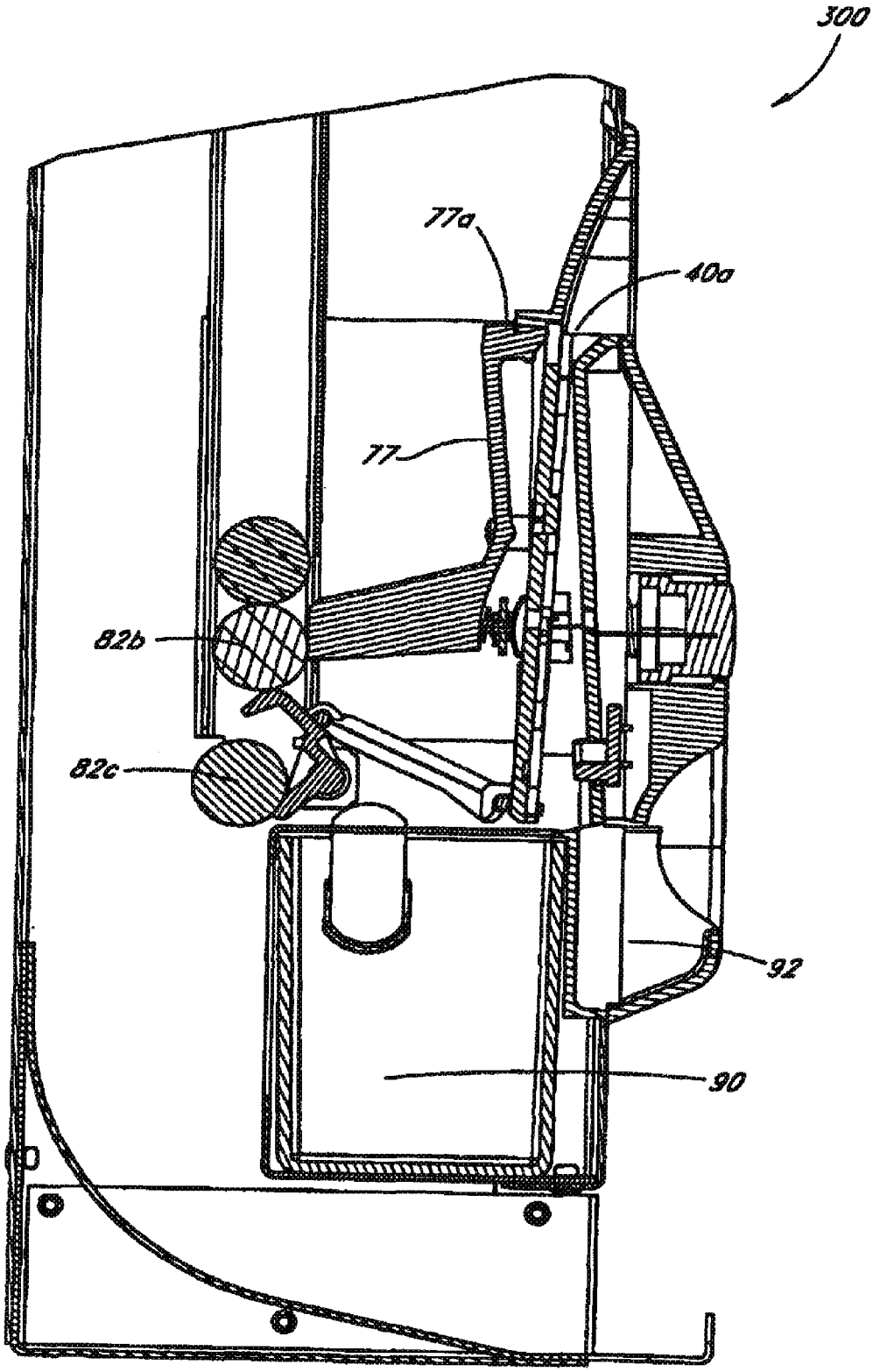
FIG. 3*b* is a crossectional side view of the vending machine of FIG. 3*a* in an actuated state.
Figure 3C:
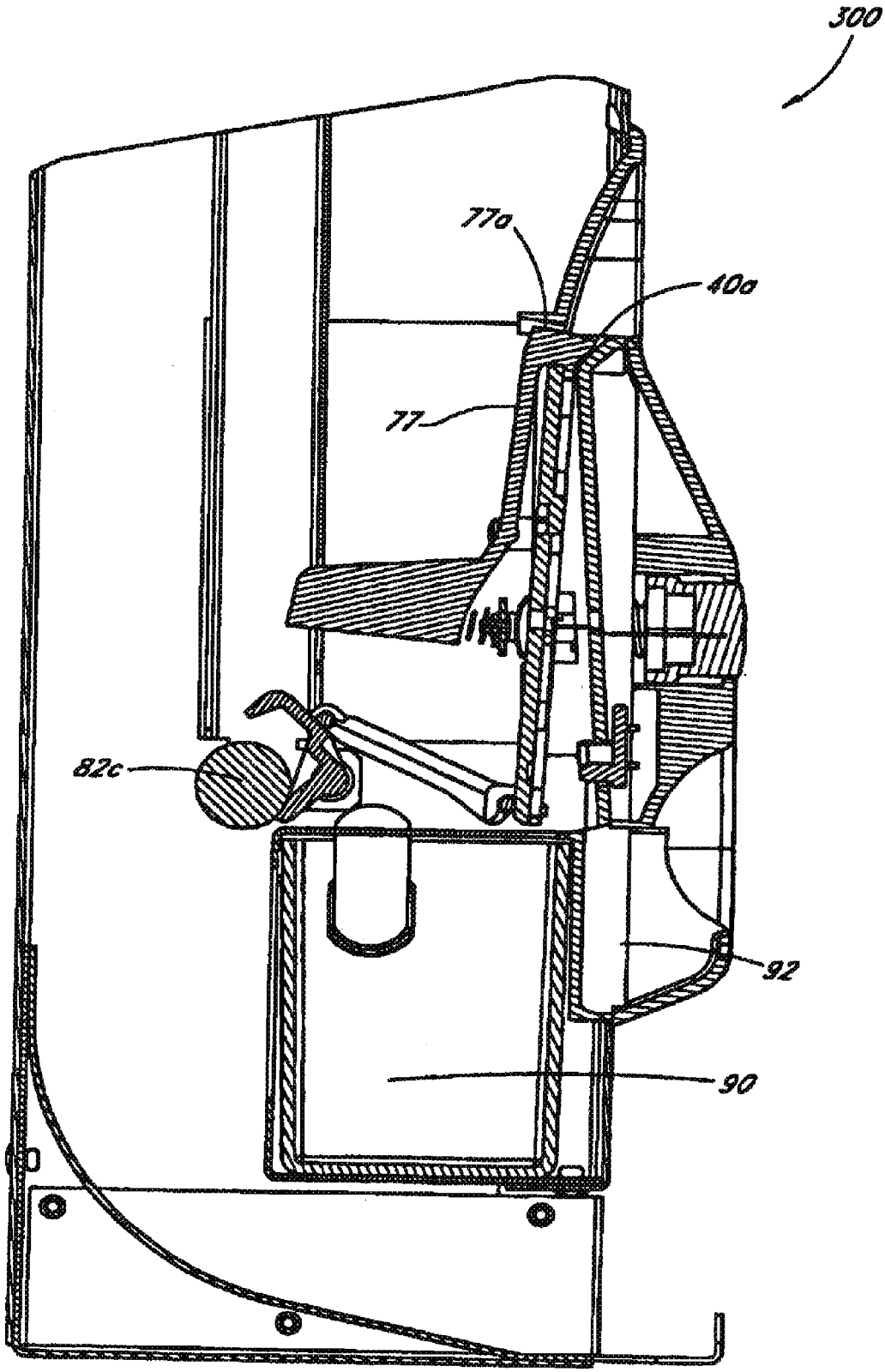
FIG. 3*c* is a crossectional side view of the vending machine of FIG. 3*a* in an actuated state while dispensing the last product in the machine.

FIGS. 3*a*-3*c* illustrate another vending machine 300 incorporating one embodiment of the coin drop mechanism 100. The vending machine 300 preferably comprises an alternate design for a product support member 84*a* used in conjunction with the coin mechanism 100. The product support member 84*a* preferably pivotally connects to the product receptacle 80*a* and a connector 84*b*. The connector 84*b* in turn connects to the channel member 20. In the illustrated embodiment, the product receptacle 80*a* is configured to preferably receive a plurality of products 82*b* having a circular crossection. The product support member 84*a* preferably comprises a to generally concave surface 84*c* configured to contact a selected product 82*c*, when the coin mechanism 100 is not actuated. The generally concave surface 84*c* preferably defines a lower edge 84*d* and an upper edge 84*e*.

As previously described, upon actuation of the coin mechanism 100, the channel member 20 is displaced relative to the support member 10. As shown in FIG. 3*b*, the channel member 20 in turn displaces the connector 84*b* toward the receptacle 80*a*, causing the product support member 84*a* to rotate such that the lower edge 84*d* does not support and is not disposed beneath the selected product 82*c*, and the upper edge 84*e* is above the selected product 82*c* and supports the at least one product 82*b*. Accordingly, the selected product 82*d* can be dispensed as discussed above.

Upon release of the actuator 70, the channel member 20 returns into contact with the support member 10, as previously described. In turn, the channel member 20 displaces the connector 84*b* away from the receptacle 80*a*, causing the product support member 84*a* to rotate such that the lower edge 84*d* supports and is disposed beneath one of the products 82*b*, which becomes the selected product 82*c*.

The flag member 77 is generally in an unlocked position when there is at least one product 82*b* in the product receptacle 80*a* above the selected product 82*c*. However, the flag member 77 is preferably biased to move into a locked position when there is not at least one product 82*b* in the product receptacle 80*a* disposed above the selected product 82*c*, as shown in FIG. 3*c*. In the locked position, the blocking portion 77*a* protrudes into the slot 40*a*, preventing a user from inserting coins into the mechanism 100. Optionally, the spring 76*a* can move the flag member 77 into the locked position upon actuation of the mechanism 100 when there is not at least one product 82*b* in the product receptacle.

Although the inventions disclosed herein have been disclosed in the context of certain preferred embodiments and examples, it will be understood by those skilled in the art that the inventions disclosed herein extend beyond the specifically disclosed embodiments to other alternative embodiments and/or uses of the inventions and obvious modifications and equivalents thereof. Thus, it is intended that the scope of the inventions disclosed herein should not be limited by the particular disclosed embodiments described above, but should be determined only by a fair reading of the claims that follow.

What is claimed is:

1. A coin mechanism for a vending machine comprising:

a first plate comprising an opening;

a second plate pivotally coupled to the first plate, wherein at least one of the first and second plates pivots relative to the other of said first and second plates between a first position wherein a portion of the first plate is in contact with a portion of the second plate and a second position wherein said portion of the first plate is not in contact with said portion of the second plate, wherein when in the first position a slot is formed between said first and second plates, wherein a surface of the first plate defines a first surface of the slot and wherein a surface of the second plate defines a second surface of the slot opposite the first surface of the slot, wherein said slot is configured to receive a coin, and wherein said opening is in communication with said slot; and an actuator comprising a portion for penetrating said opening and extending in said slot, wherein when said coin at least partially obstructs said opening, and actuation of said actuator will transmit a force to said coin which will cause the second plate to pivot relative to the first plate to the second position.

2. The coin mechanism as recited in claim 1 wherein when said coin does not obstruct said opening, actuation of said actuator will not cause the force to be transmitted thereby it will not cause the second plate to pivot relative to the first plate to the second position.

3. The coin mechanism as recited in claim 1 wherein when said second plate pivots to the second position said mechanism causes a product to be dispensed from said dispensing machine.

4. The coin mechanism of claim 1 wherein when in the second position the mechanism allows for the dispensing of a selected product from the vending machine.

5. The coin mechanism of claim 1 further comprising a product support member, said product support member being displaced by said second plate when said second plate is in the second position for dispensing a product of the vending machine.

6. The coin mechanism of claim 1 further comprising another opening formed through the second plate, wherein said actuator portion penetrates said opening formed on said first plate, extends through the slot and penetrates said another opening formed through said second plate.

7. A coin mechanism for a vending machine comprising:

a first plate comprising a first opening;

a second plate comprising a second opening, wherein said second plate is pivotally coupled to the first plate, wherein at least one of the first and second plates pivots relative to the other of said first and second plates between a first position and a second position, wherein in the first position a slot is defined between said first and second plates, wherein a surface of the first plate defines a first surface of the slot and wherein a surface of the second plate defines a second surface of the slot opposite the first surface of the slot, wherein said slot is configured to receive a coin, wherein in the second position, a portion of the second plate is spaced further from a portion of the first plate than said portion of the second plate is spaced from said portion of the first plate when in the first position, and wherein said first and second openings are in communication with said slot; and an actuator comprising a portion for penetrating said first opening, said slot and said second opening and for exerting a force against a coin for pivoting the second plate relative to the first plate to the second position.

8. The coin mechanism of claim 7 wherein when in the second position the mechanism allows for the dispensing of a selected product from the vending machine.

9. The coin mechanism of claim 7 further comprising a product support member, said product support member being displaced by said second plate when said second plate is in the second position for dispensing a product of the vending machine.

10. A coin operated dispensing system comprising:

a product receptacle for holding a plurality of products including a first product and a second product on top of the first product;

a product support member comprising an upper edge and a lower edge, wherein the lower edge extends below the product receptacle for preventing the dispensing of a product from a lower end of the product receptacle;

a coin drop mechanism comprising a pivotable member pivotable between a first position and a second position, and an actuator for pivoting said pivotable member, said pivotable member being pivotable from the first position to the second position about a pivotable member axis upon receipt of a coin in said mechanism; and a connector pivotally connected to the product support member about a first pivot axis and to the pivotable member about a second pivot axis, wherein the pivotable member axis is different from said first axis and from said second axis and is at least generally parallel to at least one of said first and second axes, wherein at least a portion of the connector extends between said first and second pivot axes, wherein pivoting of the pivotable member to the second position causes the connector to apply a force to the product support member to pivot said product support member about the first pivot axis wherein the lower edge rotates away from the product receptacle allowing for the dispensing of the first product while the upper edge rotates into the product receptacle for preventing the second product from being dispensed, and wherein pivoting of the pivotable member to the first position causes the upper edge to move away from the receptacle and the lower edge to rotate to a position below the receptacle allowing the second product to move down the receptacle and rest against the lower edge.

11. The system as recited in claim 10 wherein a generally C-shaped channel is defined between the upper and lower edge.

12. The system as recited in claim 10 wherein said plurality of products are cylindrical.

13. The system as recited in claim 12 wherein said cylindrical products have a diameter and wherein said distance between said upper and lower edge is about the same as said diameter.

14. The system as recited in claim 10 wherein the mechanism comprises a slot for receiving the coin and wherein the system further comprises a pivotable flag having a first end portion and a second end portion, wherein the flag pivots into a first position wherein the first end portion penetrates the receptacle when there is no more than one product remaining in the receptacle and the second end portion moves over the mechanism slot for preventing the insertion of a coin in said mechanism slot.

15. The system as recited in claim 10 wherein the upper edge is formed on an upper member, wherein the lower edge is formed on a lower member, and wherein the upper member is spaced apart from the lower member.

16. The system as recited in claim 10 wherein the upper edge is fixed relative to the lower edge.

17. A coin operated dispensing system comprising:

a product receptacle for holding a plurality of products including a first product and a second product on top of the first product;

a product support member comprising an upper edge and a lower edge, wherein the lower edge extends below the product receptacle for preventing the dispensing of a product from a lower end of the product receptacle;

a coin drop mechanism comprising a pivotable member pivotable between a first position and a second position, and an actuator for pivoting said pivotable member, said pivotable member being pivotable from the first position to the second position upon receipt of a coin in said mechanism; and a connector pivotally connected to the product support member about a first pivot axis and to the pivotable member about a second pivot axis, wherein at least a portion of the connector extends between the first and second pivot axes, wherein pivoting of the pivotable member to the second position causes the connector to apply a force to the product support member to pivot said product support member about the first pivot axis wherein the lower edge rotates away from the product receptacle allowing for the dispensing of the first product while the upper edge rotates into the product receptacle for preventing the second product from being dispensed, wherein pivoting of the pivotable member to the first position causes the upper edge to move away from the receptacle and the lower edge to rotate to a position below the receptacle allowing the second product to move down the receptacle and rest against the lower edge, and wherein the mechanism comprises a slot for receiving the coin and wherein the system further comprises a pivotable flag having a first end portion and a second end portion, wherein the flag pivots into a first position wherein the first end portion penetrates the receptacle when there is no more than one product remaining in the receptacle and the second end portion moves over the mechanism slot for preventing the insertion of a coin in said mechanism slot.

18. The system as recited in claim 17 wherein a generally C-shaped channel is defined between the upper and lower edge.

19. The system as recited in claim 17 wherein said plurality of products are cylindrical.

20. The system as recited in claim 19 wherein said cylindrical products have a diameter and wherein said distance between said upper and lower edge is about the same as said diameter.

21. The system as recited in claim 17 wherein the upper edge is formed on an upper member, wherein the lower edge is formed on a lower member, and wherein the upper member is spaced apart from the lower member.

22. A coin operated dispensing system comprising:

a product receptacle for holding a plurality of products including a first product and a second product on top of the first product;

a product support member comprising an upper edge and a lower edge fixed relative to the upper edge, wherein the lower edge extends below the product receptacle for preventing the dispensing of a product from a lower end of the product receptacle;

a coin drop mechanism comprising a pivotable member pivotable between a first position and a second position, and an actuator for pivoting said pivotable member, said pivotable member being pivotable from the first position to the second position upon receipt of a coin in said mechanism; and a connector pivotally connected to the product support member about a first pivot axis and to the pivotable member about a second pivot axis, wherein at least a portion of the connector extends between said first and second axes, wherein pivoting of the pivotable member to the second position about a pivotable member axis causes the connector to apply a force to the product support member to pivot said product support member about a third pivot axis being generally parallel to the pivotable member axis and being spaced apart from the first pivot axis and the second pivot axis wherein the lower edge rotates away from the product receptacle allowing for the dispensing of the first product while the upper edge rotates into the product receptacle for preventing the second product from being dispensed, and wherein pivoting of the pivotable member to the first position causes the upper edge to move away from the receptacle and the lower edge to rotate to a position below the receptacle allowing the second product to move down the receptacle and rest against the lower edge.

23. The system as recited in claim 22 wherein a generally C-shaped channel is defined between the upper and lower edge.

24. The system as recited in claim 22 wherein said plurality of products are cylindrical.

25. The system as recited in claim 24 wherein said cylindrical products have a diameter and wherein said distance between said upper and lower edge is about the same as said diameter.

26. The system as recited in claim 22 wherein the mechanism comprises a slot for receiving the coin and wherein the system further comprises a pivotable flag having a first end portion and a second end portion, wherein the flag pivots into a first position wherein the first end portion penetrates the receptacle when there is no more than one product remaining in the receptacle and the second end portion moves over the mechanism slot for preventing the insertion of a coin in said mechanism slot.

27. The system as recited in claim 22 wherein the upper edge is formed on an upper member, wherein the lower edge is formed on a lower member, and wherein the upper member is spaced apart from the lower member.

28. A coin operated dispensing system comprising:

a product receptacle for holding a plurality of products including a first product and a second product on top of the first product;

a product support member comprising an upper edge and a lower edge, wherein the lower edge extends below the product receptacle for preventing the dispensing of a product from a lower end of the product receptacle;

a coin drop mechanism comprising a pivotable member pivotable between a first position and a second position, and an actuator for pivoting said pivotable member, said pivotable member being pivotable from the first position to the second position about a pivotable member axis upon receipt of a coin in said mechanism;

a connector pivotally connected to the product support member about a first pivot axis and to the pivotable member about a second pivot axis, wherein the pivotable member axis is different from said first axis and from said second axis, wherein at least a portion of the connector extends between said first and second pivot axes, wherein pivoting of the pivotable member to the second position causes the connector to apply a force to the product support member to pivot said product support member about the first pivot axis wherein the lower edge rotates away from the product receptacle allowing for the dispensing of the first product while the upper edge rotates into the product receptacle for preventing the second product from being dispensed, and wherein pivoting of the pivotable member to the first position causes the upper edge to move away from the receptacle and the lower edge to rotate to a position below the receptacle allowing the second product to move down the receptacle and rest against the lower edge, wherein the mechanism comprises a slot for receiving the coin; and a pivotable flag having a first end portion and a second end portion, wherein the flag pivots into a first position wherein the first end portion penetrates the receptacle when there is no more than one product remaining in the receptacle and the second end portion moves over the mechanism slot for preventing the insertion of a coin in said mechanism slot.

* * * * *